US005738615A

United States Patent [19]

McCollum et al.

[11] Patent Number: 5,738,615

[45] Date of Patent: Apr. 14, 1998

[54] APPARATUS FOR INITIALLY POSITIONING A WEIGHT LIFTING HANDLE

[76] Inventors: Robert P. McCollum, 34 Linda Dr., Transfer, Pa. 16154; Jerry K. Leipheimer, 103 Oak La., Jamestown, Pa. 16134; Gregory T. Telesz, R.D. 3 Box 206, Volant, Pa. 16156

[21] Appl. No.: 393,100

[22] Filed: Feb. 22, 1995

[51] Int. Cl.[6] ..... A63B 21/06

[52] U.S. Cl. ..... 482/101; 482/98; 482/908

[58] Field of Search ..... 482/94, 98, 101, 482/104, 137, 93, 97, 100, 135, 136, 138

[56] References Cited

U.S. PATENT DOCUMENTS

| | | | |
|---|---|---|---|
| 3,746,338 | 7/1973 | Proctor | 482/101 |
| 4,346,888 | 8/1982 | Szabo | 482/101 |
| 4,470,596 | 9/1984 | Desiderio | 482/135 X |
| 4,856,774 | 8/1989 | Kowalcyk | 482/104 |
| 5,362,290 | 11/1994 | Huang | 482/908 X |
| 5,417,634 | 5/1995 | Habing | 482/137 X |
| 5,429,569 | 7/1995 | Gunnari | 482/137 X |

FOREIGN PATENT DOCUMENTS

| | | | |
|---|---|---|---|
| 2184953 | 7/1987 | United Kingdom | 482/101 |

*Primary Examiner*—Richard J. Apley
*Assistant Examiner*—William LaMarca

[57] ABSTRACT

In a weight lifting machine having a manually engageable mechanism which is movable along a predetermined path of movement wherein the manually engageable mechanism is anchorable to a weight mechanism which resists movement of the manually engageable mechanism, an apparatus for positioning the manually engageable mechanism in a selected initial position along the path movement, the apparatus comprising, an elongated rod having a mesh mechanism on a surface of the rod and a sleeve having a mesh mechanism receivably interlockable with the mesh mechanism of the rod, one of the rod and the sleeve being connected to the manually engageable mechanism and movable in unison with movement of the manually engageable mechanism, the other of the rod and the sleeve being anchored to the weight mechanism, the mesh mechanisms of the rod and the sleeve being reversibly interlockable and unlockable such that the rod and the sleeve move in unison with each other when interlocked and such that the manually engageable mechanism is freely movable through its predetermined path of movement when the rod and the sleeve are unlocked from each other.

31 Claims, 15 Drawing Sheets

APPARATUS FOR INITIALLY POSITIONING A WEIGHT LIFTING HANDLE

BACKGROUND OF THE INVENTION

The present invention relates to weight lifting apparati and more particularly to an apparatus which enables the user of a weight lifting apparatus to selectively position the handle or bar which the user engages to lift the weights of aay desired initial or starting position which is convert for the user.

Prior systems for initially positioning a weight lifting apparatus handle or bar or the like have only allowed the user to position the bar at discrete grossly distanced positions along the path of travel of the handle or bar. Such discrete grossly distanced initial positions do not however necessarily provide an ideally convenient starting position for the user because the grossly distanced starting positions are not necessarily suited to the particular size, length, height, shape or other dimensions of any one particular user.

SUMMARY OF THE INVENTION

The present invention provides a starting positioning apparatus which enables the user of a weight lifting apparatus to selectively position the handle, bar or other manually engageable weight lifting device at essentially any starting position along the path of travel of the handle, bar or the like and not simply at one of a relatively few number of discrete grossly distanced positions.

In accordance with the invention therefore there is provided in a weight lifting machine having a manually engageable mechanism which is movable along a predetermined path of movement wherein the manually engageable mechanism is interconnected to a weight mechanism which resists movement of the manually engageable mechanism in at least one direction along the predetermined path of movement, an apparatus for positioning the manually engageable mechanism in a selected initial or starting position along the path movement without weight resistance, the apparatus comprising:

an elongated rod having a mesh mechanism on a surface of the rod and a sleeve having a mesh mechanism receivably interlockable with the mesh mechanism of the rod;

one of the rod and the sleeve being interconnected to the manually engageable mechanism and movable in unison with movement of the manually engageable mechanism;

the other of the rod and the sleeve being connected to the weight mechanism;

the mesh mechanisms of the rod and the sleeve being reversibly interlockable and unlockable such that the rod and the sleeve move in unison with each other when interlocked and such that the manually engageable mechanism is freely movable through its predetermined path of movement without weight resistance when the rod and the sleeve are unlocked from each other.

The weight mechanism preferably comprises a weight stack having a plurality of discrete weight elements selectively interconnectable to one of the rod and the sleeve.

The mesh mechanisms of the rod and the sleeve are preferably constantly biased into lockable engagement with each other by a spring mechanism.

The spring mechanism is typically arranged such that the spring engages one of the rod and sleeve urging the mesh mechanism of one of the rod and the sleeve into engagement with the mesh mechanism of the other of the rod and the sleeve.

The apparatus preferably includes a lever pivotably mounted at a fulcrum for reversibly disengaging and engaging the mesh mechanisms of the rod and the sleeve. The lever is engageable on one side of the fulcrum with one of the sleeve and the rod and engageable on an opposing side of the fulcrum with a lever pivot mechanism which is manually actuatable for pushing or pulling on the lever such that the lever pivots on the fulcrum causing the spring to be compressed or extended and thereby causing the mesh mechanism to be disengaged or engaged upon the compression or extension of the spring.

BRIEF DESCRIPTION OF THE DRAWINGS

FIG. 9 is a side schematic cross-sectional view of the

FIG. 6 sleeve component showing the threaded rod component lockably received or meshed within the receiving threads of the sleeve component;

DETAILED DESCRIPTION OF INVENTION

Figure 1:
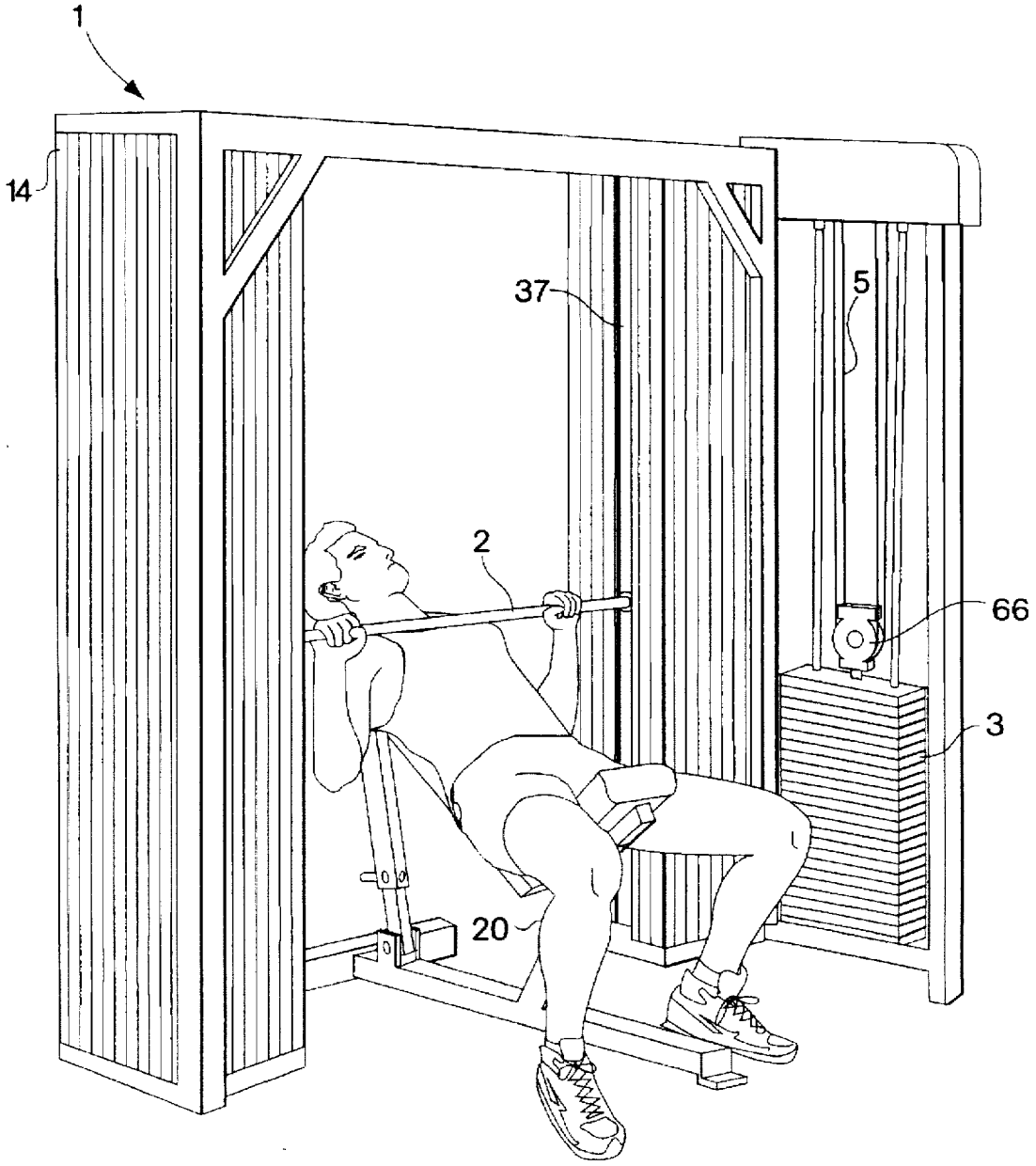
FIG. 1 is a perspective view of a weight lifting apparatus similar to a Smith press having a handle bar selectively anchorable to a weight stack.

FIG. 1 shows a weight lifting machine 1 similar to a Smith press with a user 20 seated in a position for performing a press-like exercise. The machine 1 comprises a handle bar 2 slidably mounted at its ends in opposing tracks 32 which define a predetermined vertical path of movement along which the ends of the bar 2 may be moved. As described below, the bar 2 is anchored to a conventional weight stack 3 through a cable 5 whereby a preselected number of individual weight elements in the stack 3 which may be selectively connected to pulley 66 resist the upward movement of the bar 2 when the bar is anchored to the pulley 66 as described below.

Figure 1A:
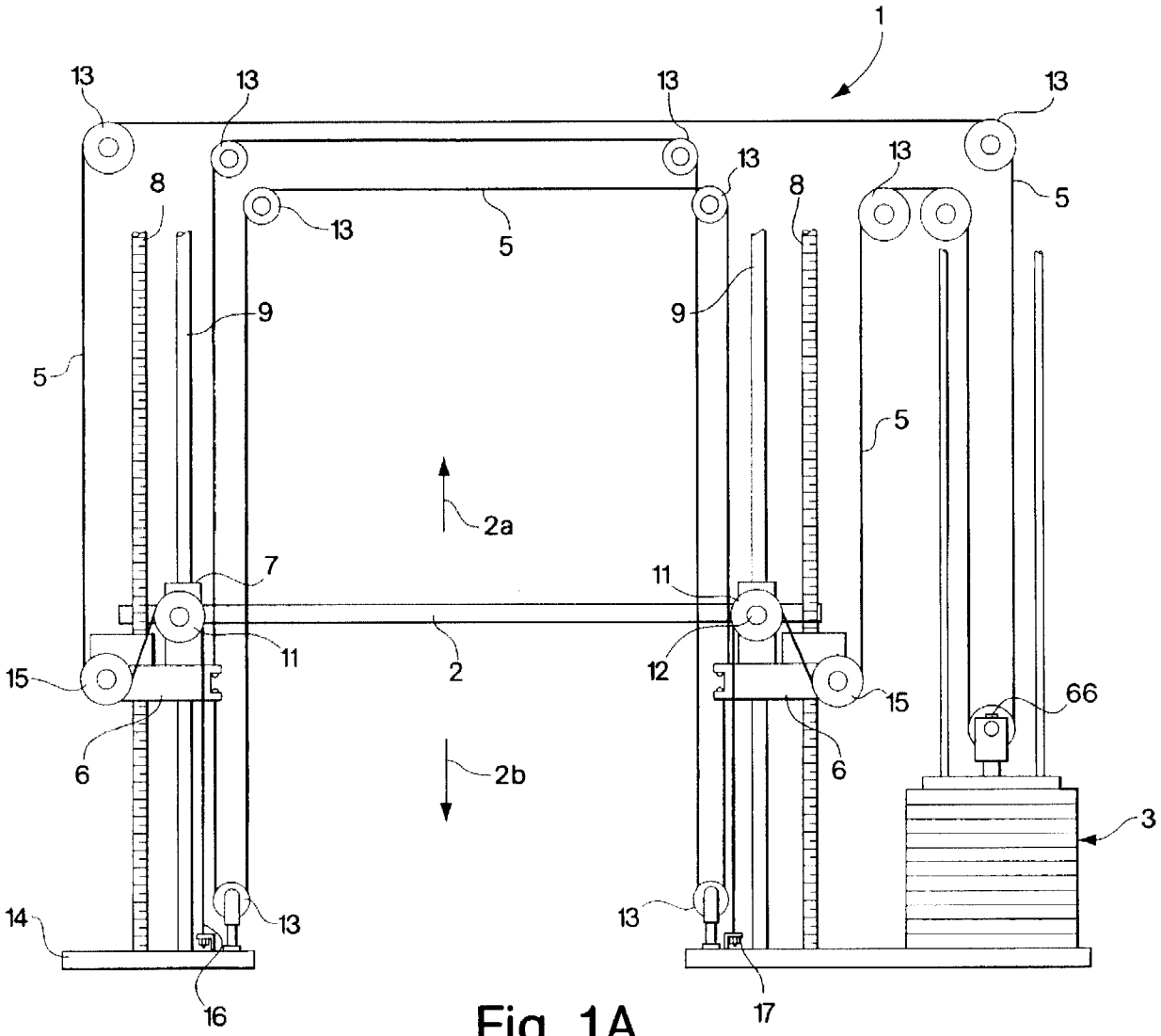
FIG. 1A is a frontal schematic view of the FIG. 1 apparatus showing the handle bar in an initial weight lifting position.

FIG. 1A schematically shows the arrangement of the bar 2 relative to a pair of threaded rods 8 and cooperative interlocking components 6 which enable the bar 2 to be selectively movable with or without resistance from the weight stack 3.

As shown in FIG. 1A the ends of the bar 2 are attached to a cylinder 7 which slidably receives a guide rod 9. Pulley wheels 11 are mounted on axles 12 which are attached to cylinders 7. As shown a series of guide pulleys 13 are fixedly mounted to a frame 1 of the machine 1. Another pair of pulleys 15 having axles attached to interlocking components 6 are also provided for enabling the selective anchoring of bar 2 to weight elements 3.

Figure 1B:
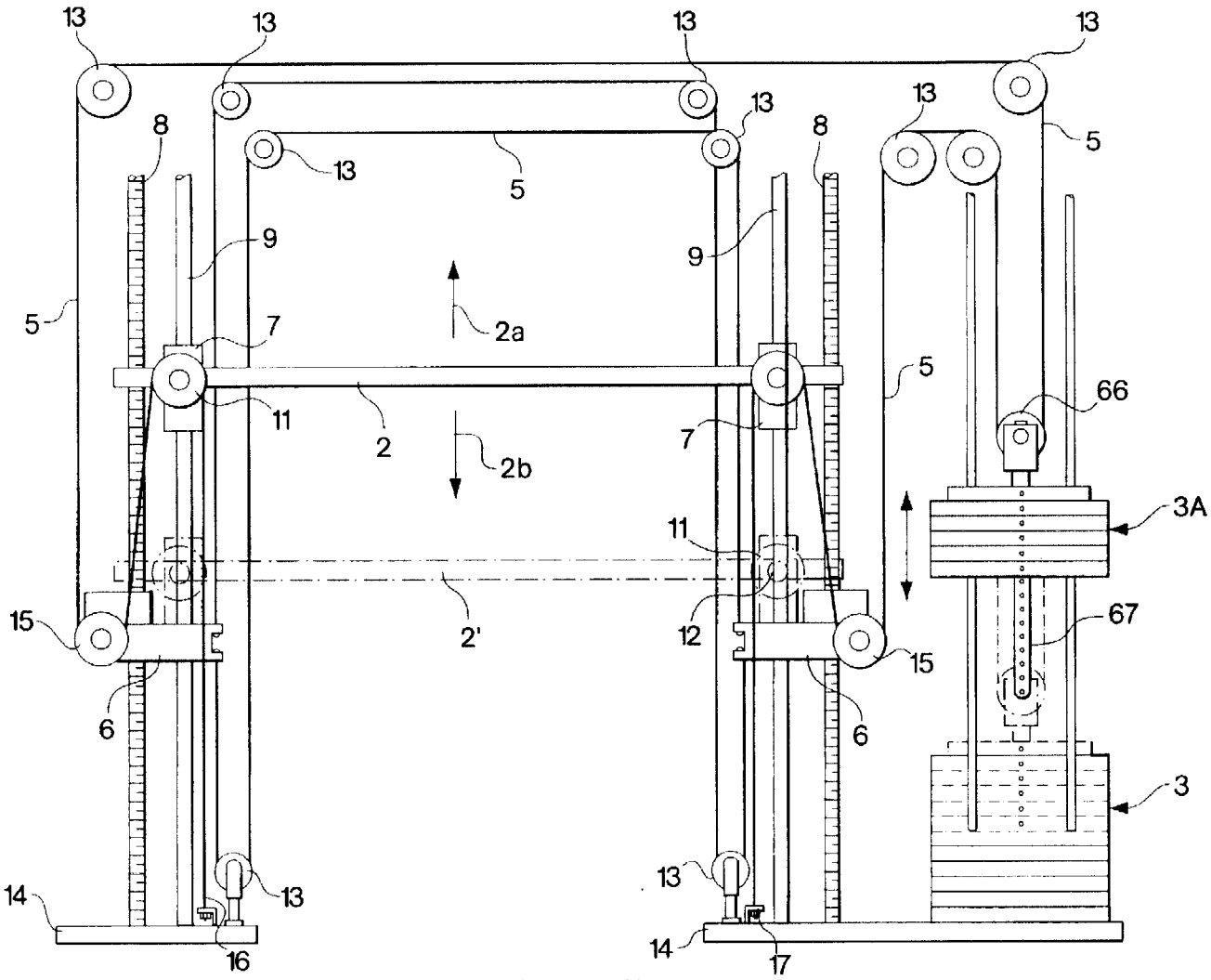
FIG. 1B is a frontal schematic view of the FIG. 1 apparatus showing the handle bar in an active weight lifting position where the weight stack is anchored to the handle bar and resisting the movement of the bar from its initial position shown in FIG. 1A.

As shown in FIGS. 1A, 1B the single mounting cable 5 has one end 16 fixedly attached to one position on the frame 14 and another end 17 fixedly attached to another position on the frame. The cable 5 extends continuously from one end 16 to another end 17 around the entire set of pulleys 11, 13, 15, 66.

In the position shown in FIG. 1A, components 6 are not interlocked with thread rods 8 and thus are freely slidable along the length of guide rods 9 together with bar 2 and its associated guide cylinders 7 and pulley wheels 11 as described more fully below with respect to FIG. 1D. Because component 6 and its associated pulley 15 can travel vertically together with cylinder 7 and its associated pulley 11, the cable 5 does not come under tension exerted by weight stack 3 when bar 2 (which is attached to cylinder 7) is moved vertically either upwardly 2*a* or downwardly 2*b*. Therefore, bar 2 can be moved 2*a*, 2*b* to any vertical position along the length of guide rods 9 when components 6 are not interlocked with threaded rods 8, FIG. 1D.

Figure 1C:
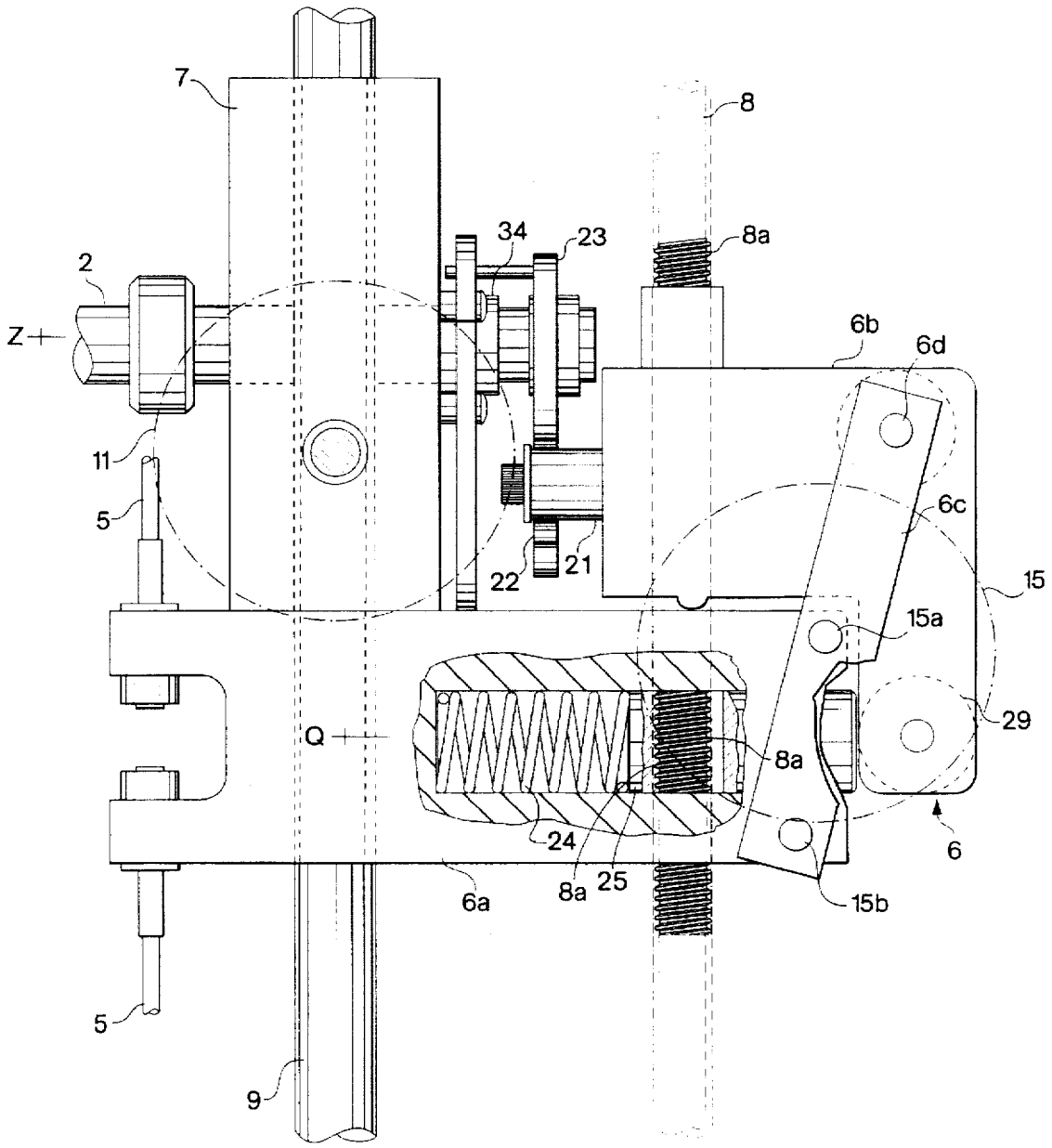
FIG. 1C is a partial sectional view of a portion of the FIGS. 1–1B apparatus showing engaged sleeve (half nut) and rod components and their associated actuation mechanism in a position whereby the handle bar is anchored to the weight stack.

FIGS. 1B, 1C show the situation where components 6 are interlocked with threaded rods 8. As shown in FIG. 1B when bar 2 is moved from its initial position 2' to the solid line position 2 shown in FIG. 1B, component 6 and pulley 15 remain in their original starting position and the cable 5 pulls upwardly around pulley 66 to lift the weight elements 3*a* which are pinned to the rod 67 as shown. When the two pulleys 11 and 15 are separated in distance from each other as between the positions shown in FIGS. 1A and 1B, pulley 15 acts as an anchor and the cable 5 comes under tension such that pulley 66 and its associated weight elements 3*a* are lifted, FIG. 1B, when the bar 2 is lifted 2*a*.

Figure 1D:
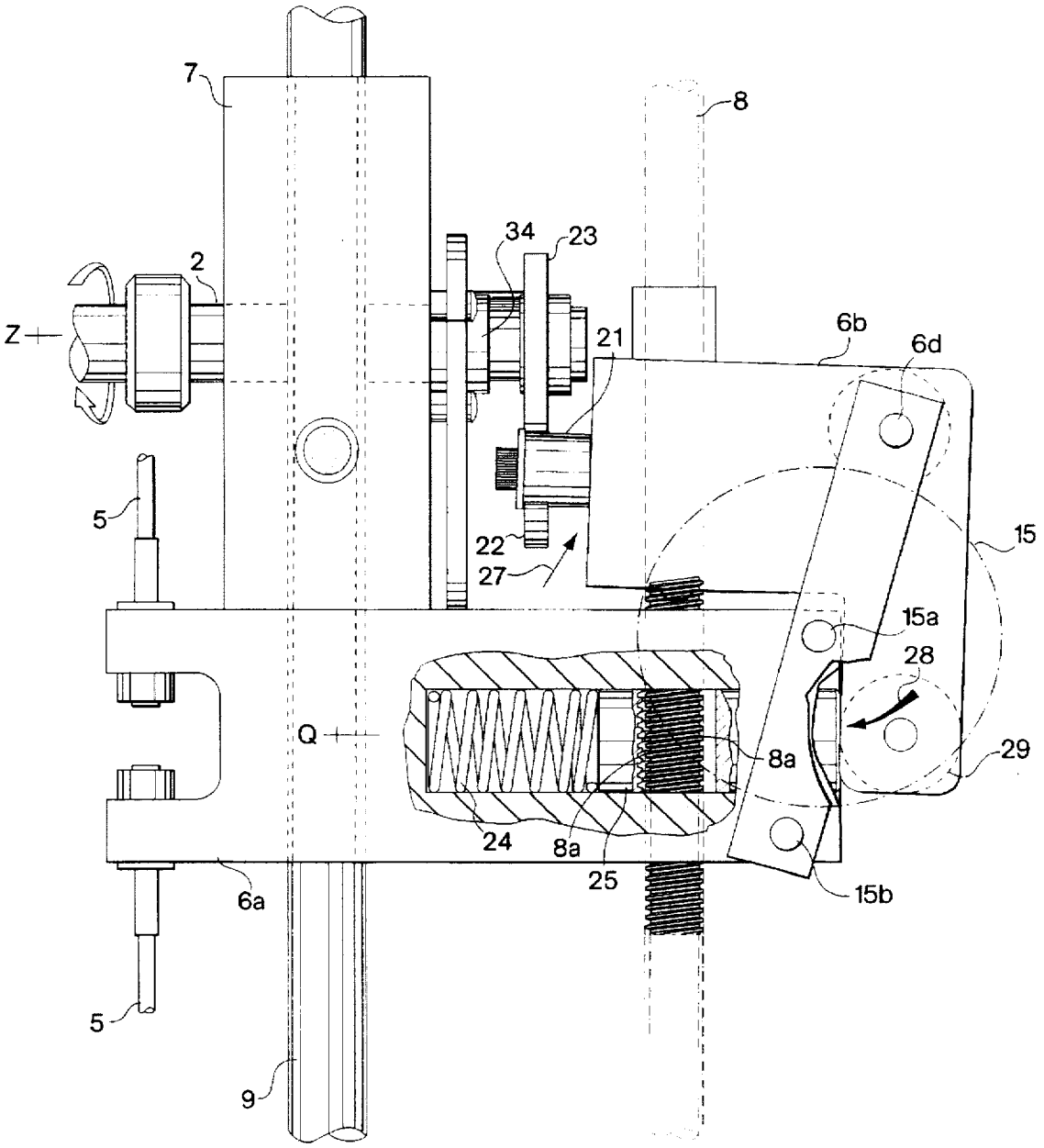
FIG. 1D is a sequential view following FIG. 1C showing the sleeve and rod components engaged with each other and the actuation mechanism pivoted to a position whereby the handle bar is not anchored to the weight stack of the machine.

FIGS. 1C and 1D show a sequence in the operation of component 6 operating between a locked and unlocked position relative to threaded rod 8. As shown in FIGS. 1A, 1B rod 8 is stationarily attached at its bottom end to frame 14 and is firmly mounted in a vertical orientation.

As shown in FIGS. 1C, 1D component 6 comprises a support bracket 6*a* which is attached to cable 5 and slidably receives guide rod 9. Component 6 includes an arm 6*b* which is pivotably mounted on bracket 6*a* via support arm 6*c*. Pivot arm 6*b* is pivotable around pivot point 6*d* as best shown in FIG. 1D. Support arm 6*c* is mounted stationarily on bracket 6*a* via axle 15*a* and pin 15*b*.

Figure 1E:
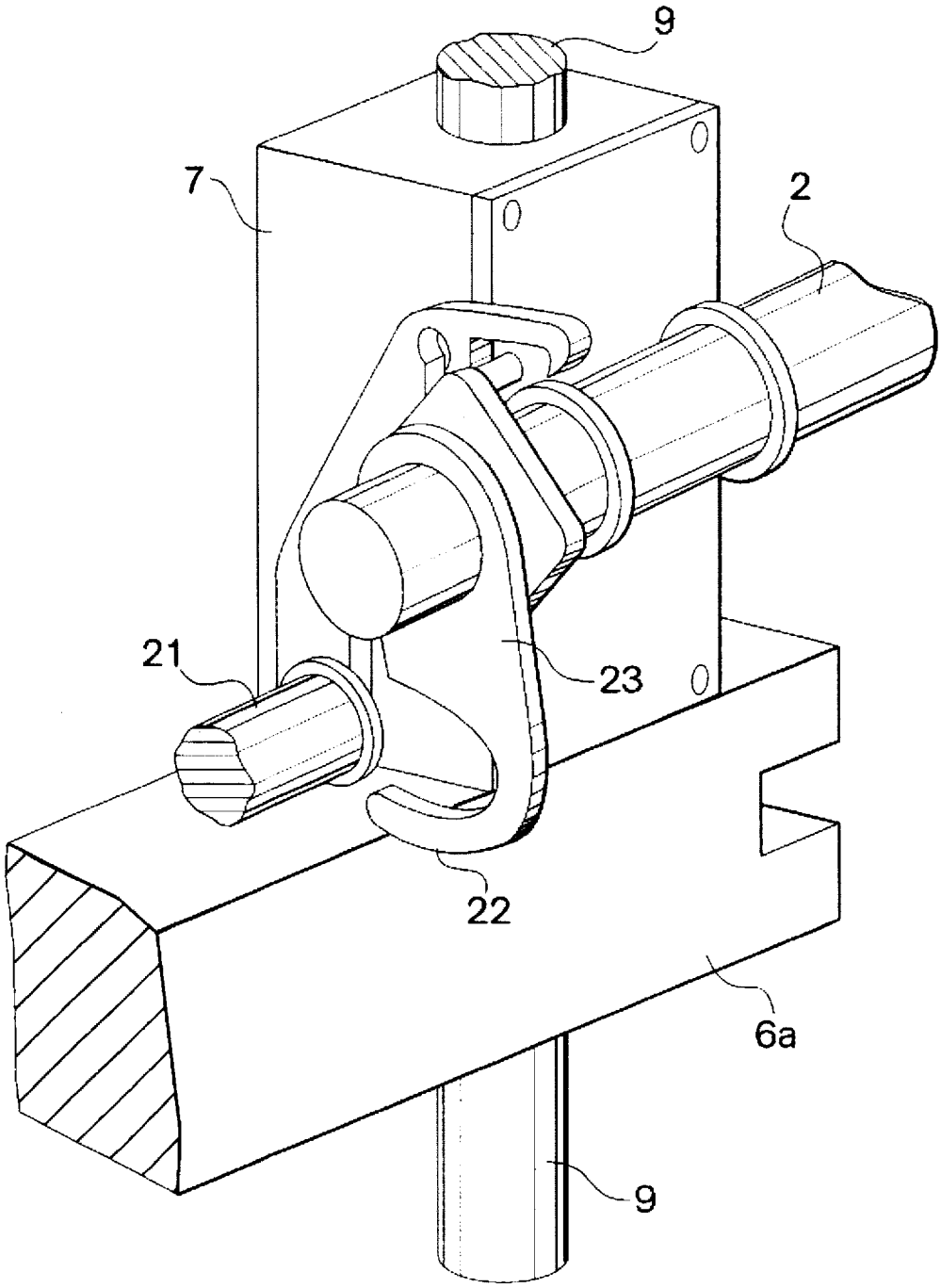
FIG. 1E is a rear perspective view of some of the FIG. 1C components showing the position of the hook element relative to the pivot arm when the apparatus is in the FIG. 1C position.

As shown in FIGS. 1C, 1D, a hook 23 is mounted on the end of bar 2 and is rotatable in unison with bar 2 around the longitudinal axis Z of bar 2. In the position shown in FIG. 1C, the hook end 22 of hook 23 is backwardly (into the page) rotated such that the hook end 22 does not engage or otherwise interfere with the vertical travel of lateral extension 21 protruding from pivot arm 6*b*. Such is shown in FIG. 1E in perspective view. Thus, the bar 2 and its associated pulley 11, if moved vertically from the position shown in FIG. 1C, will separate from bracket 6*a* and its associated pulley 15.

Further in the FIG. 1C position, the threads or mesh of half nut 25 are lockably meshed with the threads 8*a* or mesh of rod 8 by virtue of the action of spring 24 which constantly urges half nut 25 into engagement with rod 8 along the length of rod 8 which is received within an aperture provided in half nut 25 as shown in FIG. 1C, 1D. The configuration and relative positioning of half nut 25 and rod are similar to that described below with reference to elements 80, 110 FIGS. 5–9.

FIG. 1D shows the situation where the user rotates 26 the bar 2 in order to set the bar 2 at a convenient starting vertical position without resistance from the weight stack. As shown in FIG. 1D when the bar 2 is rotated 26 around its axis Z, the hook 23 is simultaneously rotated and the hook end 22 engages around the bottom end of protrusion 21 and lifts protrusion 21 upwardly causing pivot arm 6*b* to rotate 27 around pivot point 6*d*. As shown in FIG. 1D as arm 6*b* pivots, wheel 29 mounted on arm 6*b* pushes 28 on the end 33 of half nut 25 compressing spring 24 and disengaging/unlocking the threads/mesh of half nut 25 from the threads/mesh 8*a* of rod 8. Half nut 25 is mounted within a complementary aperture provided in bracket 6a as shown in FIGS. 1C, 1D such that the half nut 25 is longitudinally slidable along its axis Q in response to the opposing end pushing forces of the spring 24 and the wheel 29.

In addition to half nut 25 disengaging from rod 8, FIG. 1D, hook end 22 is engaged around the bottom end of protrusion 21 thus causing all of bracket 6*a*, pulley 15, cylinder 7 and pulley 11 to move in vertical unison when bar 2 is moved either upwardly 2*a* or downwardly 2*b*, FIGS. 1A, 1B. Thus in the FIG. 1D pivoted position, the user can freely position the bar 2 in any vertical position along the length of guide rods 9 without resistance from the weight stack.

The bar 2 is mounted in a sleeve 34 which allows the user to freely rotate the bar 2 by hand back and forth around axis Z. In practice the bar 2 may be spring loaded to be biased into a rotational position wherein hook end 22 is normally in either of the positions shown in FIGS. 1C or 1D.

Figure 2:
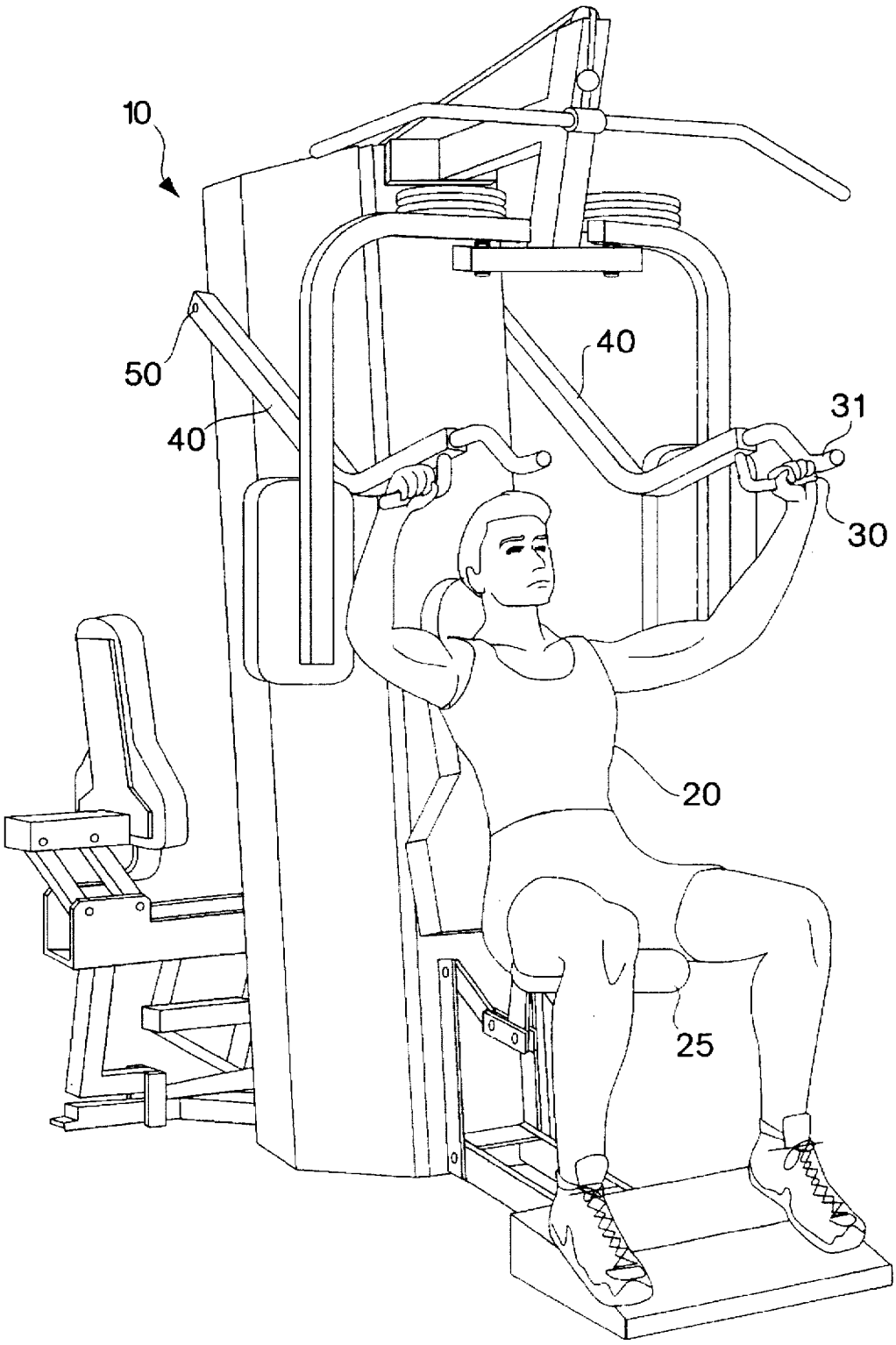
FIG. 2 is a perspective view of a multi-station exercise apparatus showing a user sitting at one station performing a press-like weight lifting exercise by upwardly pushing on the handles of a pair of pivoting arms which are interconnected to a weight mechanism.

FIG. 2 shows an exercise machine 10 and a subject 20 sitting at a station performing a press-like upward lifting exercise. As shown the subject's hands are pushing upwardly on a pair of handles 30 connected to a pair of pivoting arms 40 which pivot at points 50.

Figure 2A:
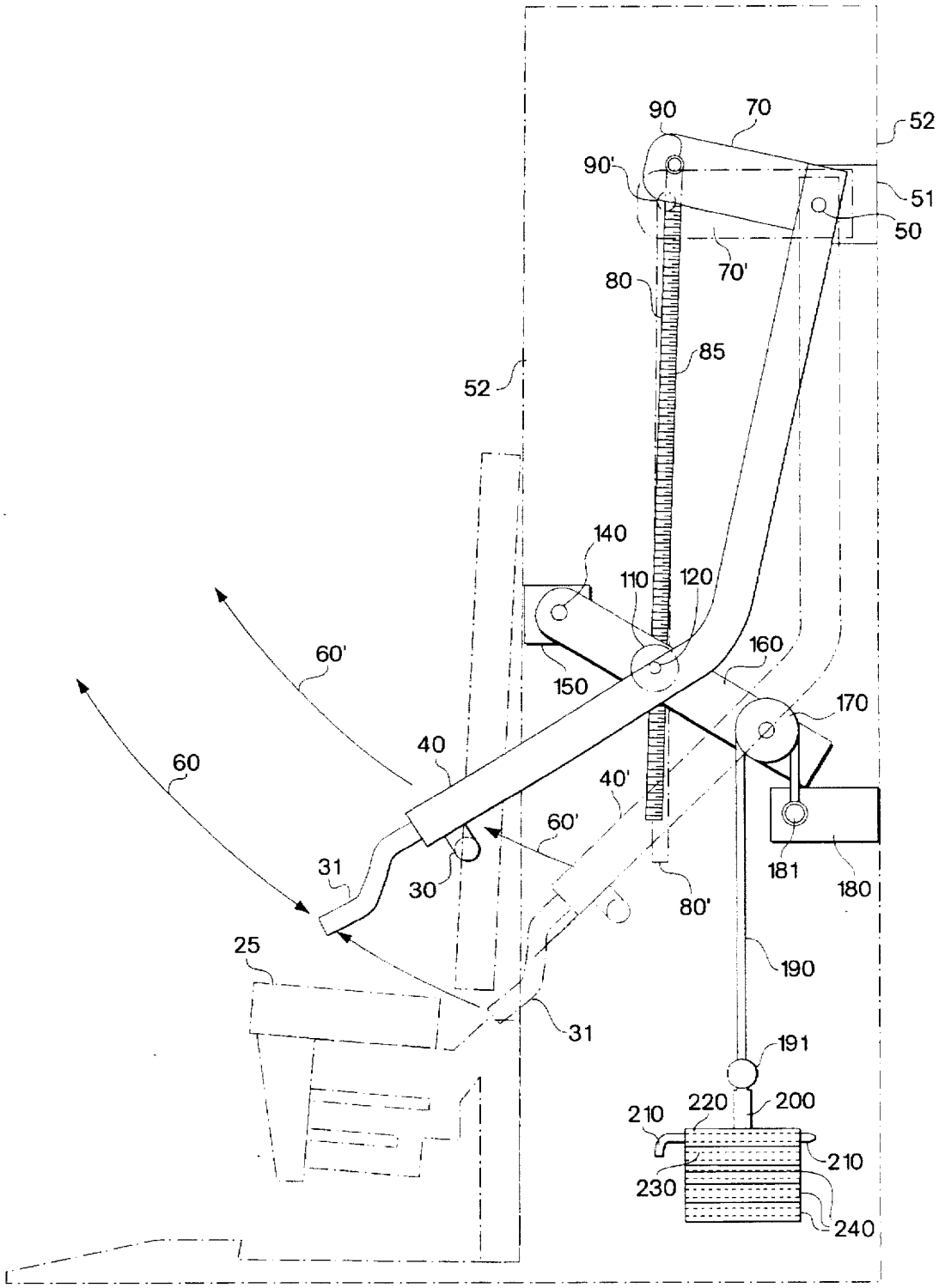
FIG. 2A is side schematic view of the machine station shown in FIG. 1 at which the user is seated, showing two starting positions at which the pivoting arms may be positioned without the weight elements being engaged.

FIG. 2A shows the pivoting arm 40 in a first dashed line position 40' and in a second solid line position 40. As shown the top end of the arm 40 is pivotably mounted on a pin, bolt or other conventional mechanism at pivot position 50 such that the handles 30, 31 travel through a predetermined arcuate path 60 when the arms 40 are pivoted around position 50. The pivot pin or the like at position 50 extends through and is stationarily mounted on a stationary bracket 51 which is fixedly attached to the superstructure or frame 52 of the machine 10. Attached to the top end of arm 40 is a bracket 70 which pivots in unison with the top end of arm 40. An elongated threaded rod 80 is pivotably connected via a pin, bolt or the like at pivot 90. As the bracket 70 is pivoted with arm 40, the rod 80 is moved generally upwardly or downwardly and simultaneously pivots around 90. As shown in FIG. 2A, when the arm 40 is in the dashed line position 40' the elongated bar is in the dashed more downward by pivoted position 80'. And, when the arm 40 is in the more upwardly pivoted solid line position 40, the rod is in the more upwardly solid line position 80.

The rod 80 extends through a receiving aperture in a sleeve 110 described in detail below with reference to FIGS. 4–9. The sleeve 110 as shown in the exemplary embodiments of FIGS. 2–9 is a generally cylindrical element and is rotatably mounted along its longitudinal axis 120 on arms 160 which are themselves pivotably mounted at position 140 on stationary extension 150 which is in turn stationarily attached to the frame 52.

Figure 4:
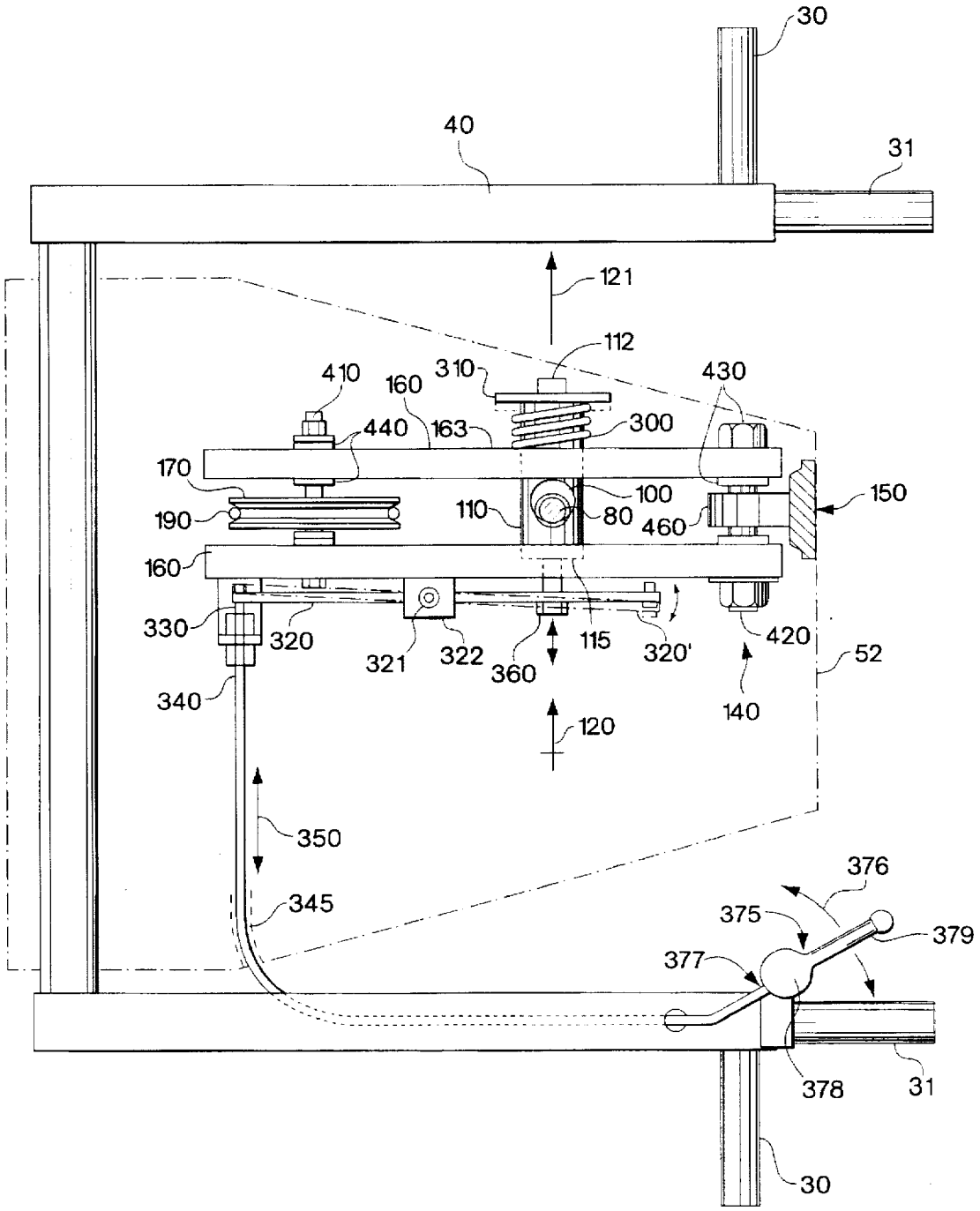
FIG. 4 is a top schematic plan view of the pivoting arm component of FIG. 3 showing a manual switch connected by a cable to a spring-loaded sleeve which is reversibly lockably engageable by meshing with a threaded rod upon actuation the switch.
Figure 5:
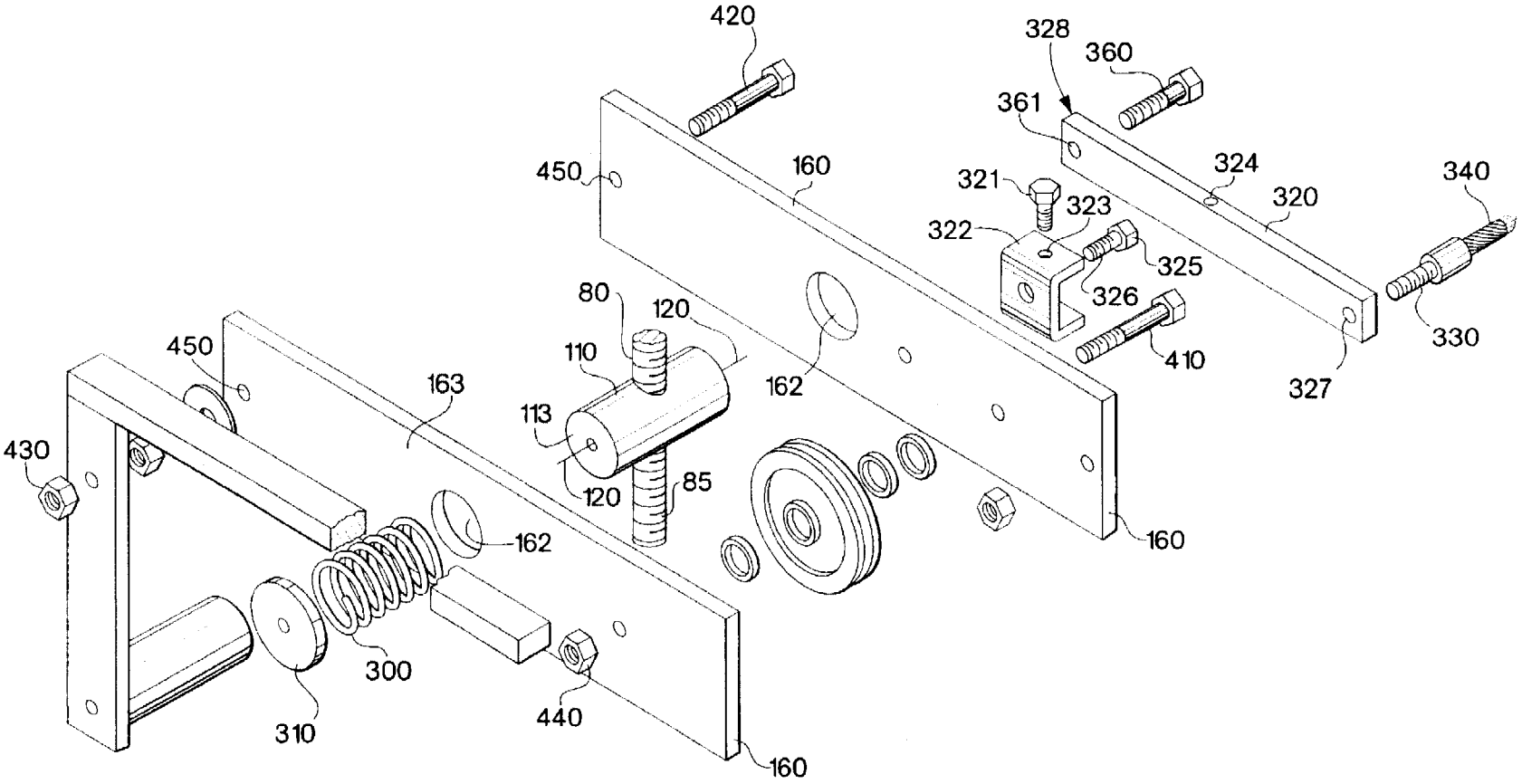
FIG. 5 is an exploded perspective view of certain components of the apparatus which mounts the spring-loaded sleeve in relation to the threaded rod shown in FIG. 4.

As shown in FIGS. 4,5 arms 160 are fixedly connected in parallel relationship to each other. The arms include apertures 162 which receive and mount sleeve 110 therein as shown in FIG. 4. A disc 310 is coaxially attached by conventional means such as via a bolt 112 to one terminal end 113 of the sleeve and a spring 300 is disposed between the disc 310 and the end 113 of the sleeve 110. One end of the spring bears or engages against the disc 310 and the other end of the spring 300 may bear against either the outward face 163 of arm 160, FIGS. 4, 5 such that when the sleeve 110 is mounted in apertures 162 as shown, the sleeve is biased in the direction 121 along its axis 120, FIG. 5.

As shown in FIGS. 4,5 a lever 320 is pivotably mounted via a bolt 321 extending through a mounting U bracket 322 aperture 323 and into lever aperture 324. The lever 320 pivots on the top surface 325 of a bolt 326 which connects U bracket 322 to one of arms 160. The top surface 325 acts as the fulcrum around which lever 320 pivots. The end 330 of a rigid cable 340 which is controllably slidable back and forth 350 within an outer mounting jacket is fixedly connected to the lever 320 through aperture 327, FIG. 5. This connection point 327 is disposed on one side of the fulcrum 325. The sleeve 110 is connected along its axis 120 on an opposite end 115, FIG. 4, of sleeve 110 to a bolt 360 which extends through an aperture 361 in lever 320, FIG. 5. As shown, the head of bolt 360 engages against the outer face 328 of lever 320 at a position on the side of fulcrum 325 opposite to aperture 327. The head of bolt 360 is maintained in engagement with the outer face 328 of lever 320 by the constant urging of sleeve 110 in the direction 121.

Lever 320 pivots around fulcrum 325, FIGS. 4,5 when cable 340 is moved back or forth 350. Cable 340 is controllably moveable by manual pivoting actuation of switch 375 in directions 376. Cable 340 is fixedly connected at end 377 in a conventional manner to the rotatable head 378 of switch 375 such that the cable 340 is slidable back and forth within its surrounding jacket 345. Other conventional means may be employed for affecting the lever 320 pivoting movement around fulcrum 325. As shown, the switch 375 is mounted at a position at or near the handles 30, 31 such that the user has ready, convenient manual access to the switch.

When the switch 375 is actuated such that the lever 320 is pivoted to the dashed line position 320', shown in FIG. 4, the sleeve 110 is disengaged from the threaded rod 80 and arms 40 may be freely pivoted around pivot position 50 without resistance from the weights 220,240 as shown in FIG. 2. For example, the arms 40 may be pivoted freely from the dashed line position 40' to the solid line position 40, FIG. 1, without weight resistance when the lever 320 is pivoted to the dashed line position 320', FIG. 4. Conversely, when the lever 320 is in the solid line position 320 shown in FIG. 4, the rod 80 is lockably engaged with the sleeve 110 and movement of the arms 40 from their solid line position 40 shown in FIG. 3 to the dashed line position 40' shown in FIG. 3 is resisted by the weight 220, FIG. 3, via the pivoting lifting of arms 160 to the dashed line position 160', FIG. 3.

Figure 3:
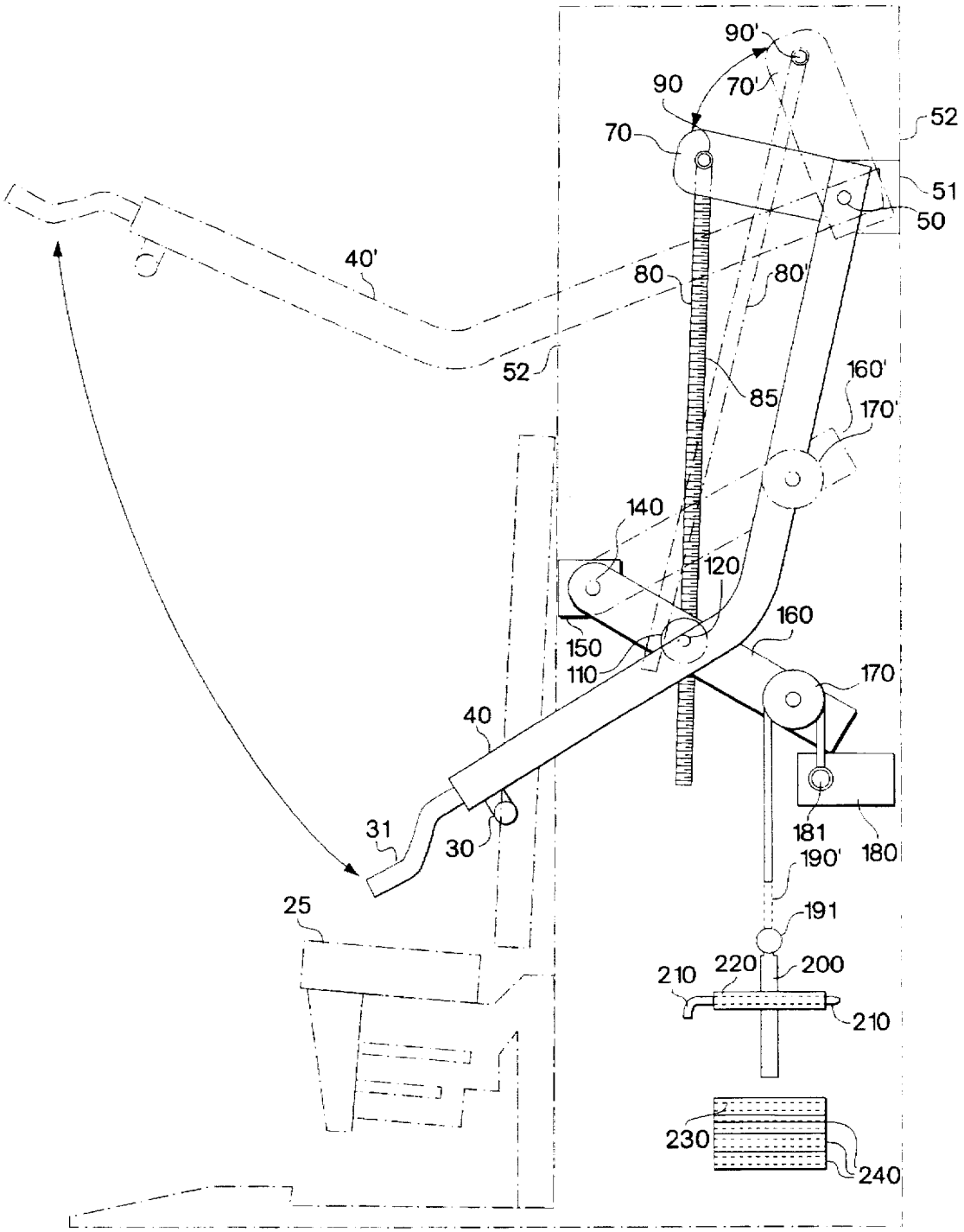
FIG. 3 is a side schematic view of the machine station shown in FIG. 2 at which the user is seated showing the pivoting arm in a selected initial position and in a second position along its path of travel where the weight elements have been engaged and are being lifted as a result of the movement from the initial position to the second position.

As can be readily imagined, when rod 80 and sleeve 110 are lockably engaged, any upward movement of rod 80 as shown in FIG. 3 will effect a concomitant upward pivoting of arms 160 and pulley wheel 170 which is rotatably mounted thereon. As pulley wheel 170 moves upwardly from position 170 to position 170', FIG. 3, cable 190' is also lifted upwardly which in turn lifts rod 200 together with however many weights are connected to rod 200 via pin 210. As schematically shown in FIGS. 2A,3, pin 210 is insertable through and selected aperture 230 provided through weights 220,240. As can be readily imagined, rod 200 is provided with a series of apertures along the length of rod 200 which are spaced so as to correspond with the apertures 230 provided in stacked weights 220, 240 such that pin 210 may be inserted through a selected weight and the rod 200 simultaneously without resistance. As shown in FIGS. 2A–5, one end of cable 190 is fixedly attached to bracket 180 which is in turn fixedly attached to frame 52; and pulley 170 is rotatably mounted between arms 160. Thus, when arms 160 are pivotably lifted upwardly such as to the dashed line position 160' from position 160 from position 160, FIG. 3, cable 190, which lies within the guide groove on the circumference of pulley 170, causes pulley 170 to rotated and, a portion of cable 190 which is connected to rod 200 is concomitantly lifted upwardly together with the upward movement of arms 160'.

Also as shown in FIG. 3, when threaded rod 80 moves to the dashed line position 80', the axis of the rod 80 is tilted. As the axis of the rod tilts in moving from position 80 to position 80', the sleeve 110 rotates around axis 120 to accommodate the tilting of rod 80 as best shown in FIG. 3. As mentioned above, arms 160 are connected together such that the arms 160 are fixedly spaced apart from each other in fixed parallel relationship via conventional connecting means such as bolts 410, 420 and cooperating nuts 430, 440.

Arms 160 are pivotably mounted on frame 52 via bolt 420 which extends through pivot point 140 aperture 450, FIG. 5, and a complementary aperture provided in extension 460 of bracket 150 which is fixedly attached to frame 52, FIG. 4.

Figure 6:
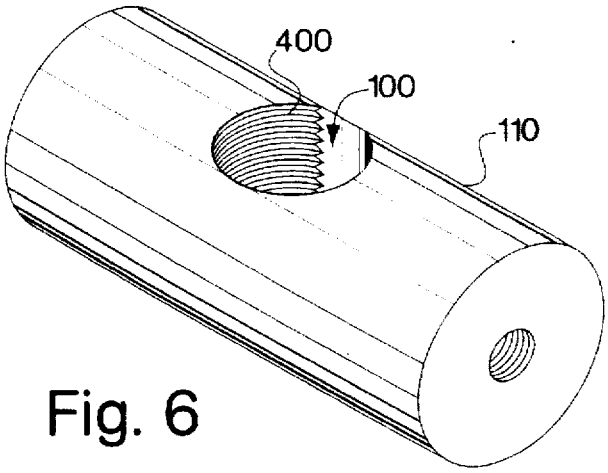
FIG. 6 is a perspective view of the sleeve component shown in FIGS. 4, 5 showing a series of receiving threads disposed on an inside surface of a generally cylindrical rod receiving aperture disposed in the sleeve.
Figure 7:
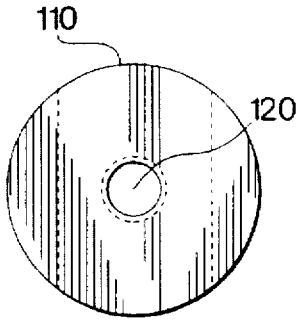
FIG. 7 is an end view of the FIG. 6 sleeve component.
Figure 8:
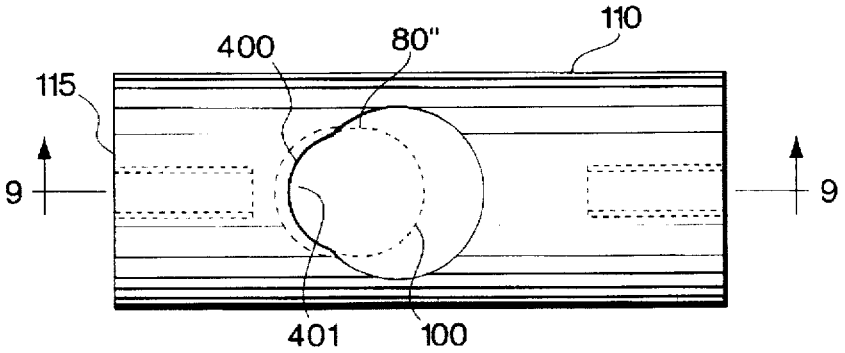
FIG. 8 is a top view of the FIG. 6 sleeve component.
Figure 9:
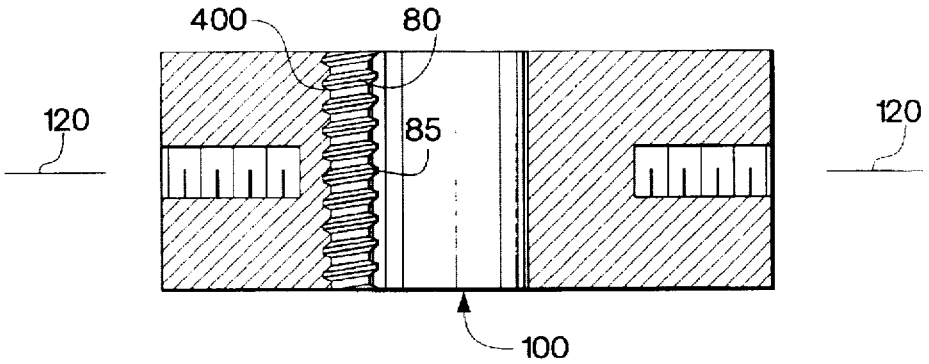

As shown in FIGS. 6, 8 a portion 400 of the inside surface of aperture 100 of sleeve 110 is threaded with threads which are complementary to/with the threads 85 provided on the surface of rod 80. Thus, when lever 320 is in the solid line position 320 shown in FIG. 4, where the sleeve 110 is urged in direction 121 by spring 300, the threads 85 on the surface of rod 80 are lockably meshed together with the threads 400 of sleeve 110 as best shown in FIG. 9. Such lockable engagement of threads 85 and threads 400 is maintained under the force of spring 300. Because arms 160 are interconnected to the weight element 220 via pulley 170, cable 190, rod 200 and pin 210, any pivoting movement upwardly of rod 80, such as to 80', FIG. 3, will concomitantly pivot arms 160 upwardly 160' and lift all of pulley 170, 170', cable 190, 190' and rod 200 and any weight element(s) which may be connected to rod 200, FIG. 3, when the threads 85 and 400, FIGS. 2,3,6,8,9 are lockably meshed together.

As mentioned above, when lever 320 is pivoted to the position 320', sleeve 110 is moved along its axis 120 in a direction opposite to direction 121 and threads 85 and 400 are unlocked or unmeshed. As shown, rod 80 is pivotably mounted on bracket 70 such that rod 80 cannot move in a lateral direction along axis 120. When threads 85 and 400 are unmeshed, the threaded rod 80 may be moved freely along its axis through aperture 100 without any pivoting movement of arms 160 and thus without resistance from weight element 220,240. Such a situation is shown, for example, in FIG. 2, where arms 40' are pivoted to position 40 without movement of arms 160. In practice, the movement of the arms 40 from one position to another position as described enables the user to initially position the arms 40 and their associated handles 30, 31 at a convenient starting position without weight resistance by simply actuating switch 375 by pushing on finger handle 379, FIG. 4, such that the cable 340 is moved to such an extent to cause lever 320 to pivot to position 320' where the threads 85 and 400 are unmeshed. Once a suitable starting position for handles 30, 31 is located along their paths of travel 60, 60' by the user, FIG. 2A, the user may then initiate a weight resistance or lifting exercise by again manually engaging finger handle 379 to cause lever 320 to pivot back to position 320, FIG. 4, where threads 85 and 400 are lockably engaged/meshed. In practice, lever 320 will normally return to position 320 from position 320' automatically as soon as the user releases finger handle 379 by virtue of the constant urging of spring 300 which causes threads 85 and 400 to mesh.

As shown in FIG. 8, the rod receiving aperture 100 is generally cylindrical and has a cross-sectional diameter which is greater than the cross-sectional diameter of rod 80, typically by at least about 0.1 to about 1 inch, such that the rod 80 is readily slidable/movable along its axis through aperture 100. Preferably, as shown in FIG. 8, the threaded portion 400 of the inside surface of aperture 100 is formed in outwardly protruding portion 401 of the circumference of aperture 100, such outwardly protruding portion 401 forming a circumferential portion of a phantom cylindrical aperture 80" which has essentially the same cross-sectional diameter as rod 80. By providing such a protrusion, the guidance of rod 80 and its threads 85 into lockable meshing engagement with threads 400 is more readily enabled and maintained when switch 375 is released.

In the embodiment of the apparatus shown in FIGS. 2–5, the sleeve component is permanently interconnected to the weight stacks or other weight resistant components of the apparatus such as pulley 170 and cable 190 whereas the threaded rod is permanently interconnected to the manual engagement components such as handles 30, 31 and arms 40. In the embodiment shown in FIGS. 10–12, the converse is true, i.e. the threaded rod 580 is permanently interconnected to the weight resistant elements 600 and the sleeve component is permanently interconnected to the manual engagement component 610.

Figure 10:
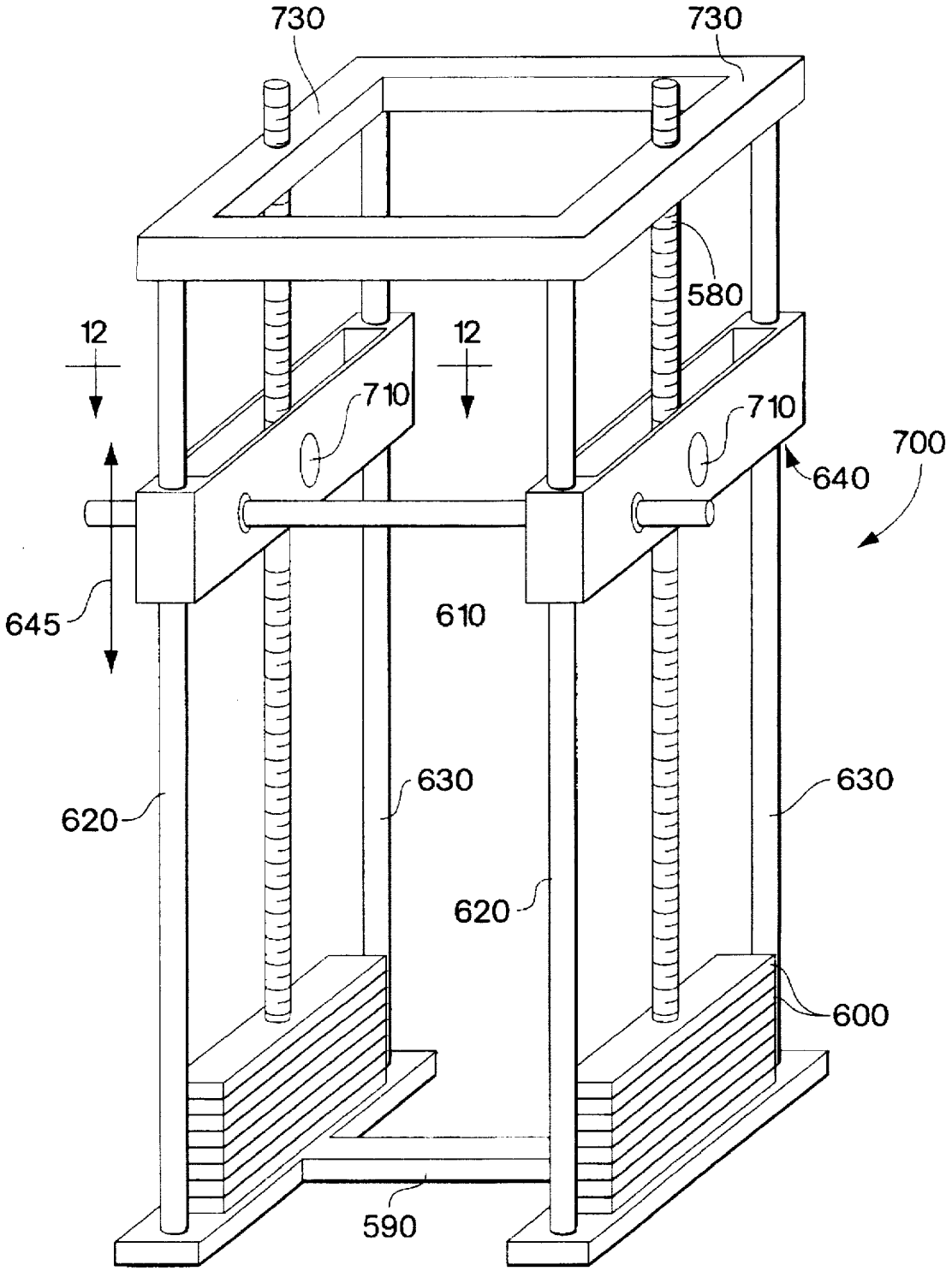
FIG. 10 is a schematic perspective view of a weight lifting apparatus similar to a Smith press having a handle bar engageable with a starting positioning mechanism according to the invention.

There is shown in FIG. 10 in schematic form a Smith press-like weight lifting apparatus 700. The apparatus 700 comprises a stationary superstructure or frame 590 having opposing upright supports 620,630 on which are mounted a pair of couplers 640 which are slidably mounted on the supports 620, 630 for slidable movement up and down 645 along the length of the supports 620, 630. A handle or press bar 610 extends through a complementary aperture in the opposing arms 650 of each coupler 640, FIGS. 10,12 such that the user can manually grasp the bar 610 and effect upward or downward 645 sliding of the couplers 640 along supports 620, 630.

Figure 11:
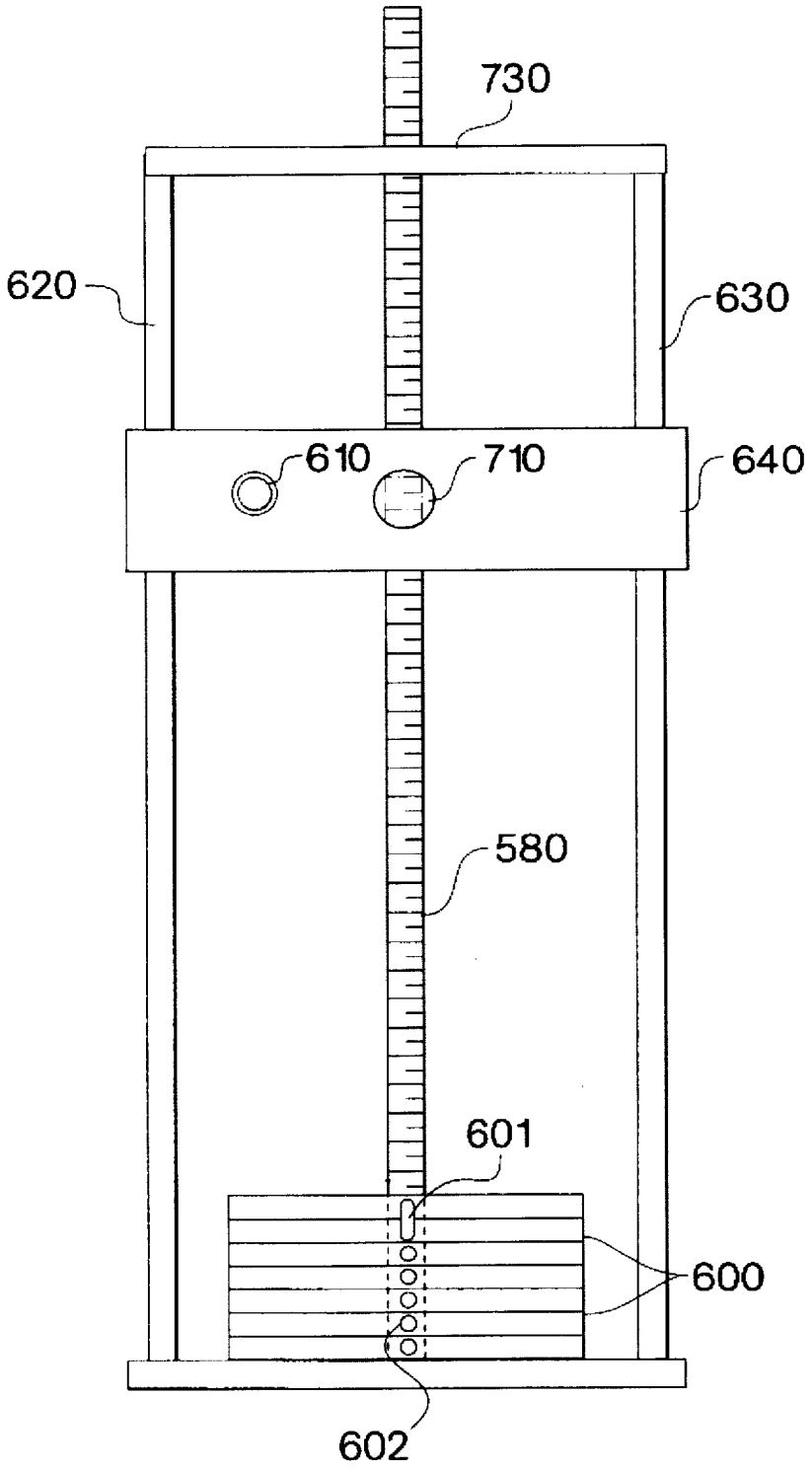
FIG. 11 is a schematic side, view of the FIG. 10 apparatus.

As shown in FIGS. 10, 11 the threaded rod 580 is permanently interconnected or interconnectable to one or more elements 600 of a weight stack 600 in the same manner as described above with reference to FIGS. 2,3 such as via a pin 601 which is selectively insertable through an aperture 602 provided in elements 600 and complementary spaced apertures provided through the rod 580 itself. The rod 580 extends upwardly through a receiving aperture 720, FIG. 12, provided in a meshing sleeve 710, FIG. 12, and the rod 580 extends further upwardly through an aperture in a horizontal support structure bar 730 at the upper end of the structure 700.

Figure 12:
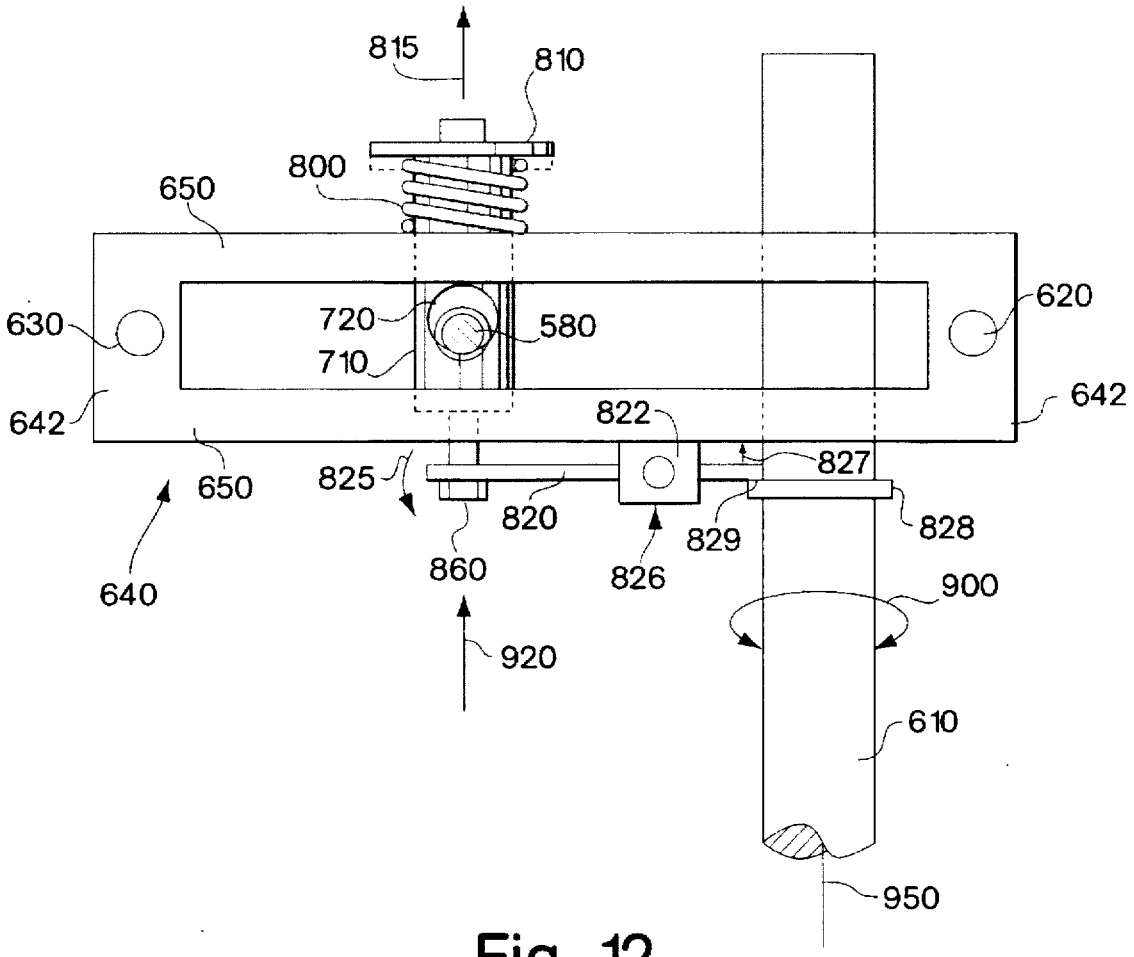
FIG. 12 is a top schematic view along lines 12—12 of FIG. 10.

With reference to FIG. 12, the coupler 640 comprises a pair of opposing parallel arms 650 and a spring loaded meshing sleeve 710. As shown the couplers have apertures in cross bars 642 which slidably receive supports 620, 630. The meshing sleeve 710 is mounted within arms 650 in the same manner as described above with respect to sleeve 110 and arms 160. And, the sleeve 710 may have the same or similar overall design/configurations as described with reference to sleeve 110 including the threads 400 and protruding portion 401, FIG. 6–9. The spring 800 and disc 810, FIG. 12, also correspond in function and structure to spring 300 and disc 310 as described above such that spring 800 constantly urges sleeve 710 in direction 815 into lockable engagement with threaded rod 580.

As can be readily imagined, when rod 580 and sleeve 710 are lockably meshed/engaged together the bar 610 and couplers 640 can only be lifted upwardly by lifting the one or more weight elements 600 which are pinned to the lower end of rod 580. Also, when the sleeve 710 and rod 580 are lockably meshed, the bar 610 and couplers 640 will be supported from sliding downwardly and maintained in whatever horizontal starting position the user selects when the user releases the bar 610.

A lever 820, FIG. 12, similar in function to lever 320, FIGS. 4,5, is provided for moving sleeve 710 in a direction opposite to direction 815 along sleeve axis 920 which effects disengagement of the threads on rod 580 from the threads 400 provided on the inside surface of aperture 720. As described above with reference to lever 320, the lever 820 pivots on a fulcrum position 826 provided within a bracket 822 (corresponding to bracket 322) to effect a sleeve release movement 825 on the head of bolt 860 (corresponding to bolt 360).

A cam element 828 is provided/attached on the circumference of bar 610 for effecting a pushing force 827 on one side of lever 820 which causes the lever 820 to pivot on fulcrum 826 and thus move the opposing side of lever 320 in direction 825 to release sleeve 710 from rod 580. As can be readily imagined, an outer surface 829 of the cam element 828 may be provided with a cammed profile sufficient to effect the movement/force 827 on the lever 320 when the bar 610 is rotated around its axis 950. The handle bar 610 is rotatably mounted 900 along its axis 950, FIG. 12, within arms 650 such that the cammed surface of element 828 may effect the pushing force 827 on lever 820. In practice, the user manually rotates 900 the handle bar 610 to release the sleeve 710 and thus enable the user to initially set the bar 610 at a convenient starting horizontal position without weight resistance other than the weight of the bar 610 and couplers 640. Preferably the rotation 900 of the bar 610 is also spring biased by conventional means to rotate into a fixed position where the cam 828 is in a position such that the lever 820 is pivoted to a position where the sleeve 700 is lockably meshed with the rod 580.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. In a weight resistance exercise machine having a manually engageable mechanism which a user manually engages during performance of a weight resistance exercise, the manually engageable mechanism being movable along a predetermined path of movement wherein the manually engageable mechanism is anchorable to a weight mechanism such that the weight mechanism resists movement of the manually engageable mechanism, an apparatus for positioning the manually engageable mechanism in a selected initial position along the path of movement without resistance from the weight mechanism, the apparatus comprising:

an elongated rod having a first mesh mechanism;

a sleeve receiving the rod, the sleeve having a second complementary mesh mechanism;

the first and second mesh mechanisms being controllably meshable and unmeshable with each other by actuation of a remote manual actuator mounted on the manually engageable mechanism;

the manually engageable mechanism being movable along the predetermined path of movement without resistance from the weight mechanism when the mesh mechanisms are unmeshed.

2. The apparatus of claim 1 wherein the manually engageable mechanism is anchored to weight mechanism when the mesh mechanisms are meshed.

3. The apparatus of claim 1 wherein the second mesh mechanism is biased into meshing engagement with the first mesh mechanism.

4. The apparatus of claim 1 wherein the sleeve comprises a half nut.

5. The apparatus of claim 1 wherein the second mesh mechanism of the sleeve is controllably movable into and out of meshing engagement with the first mesh mechanism.

6. The apparatus of claim 3 wherein the second mesh mechanism of the sleeve is controllably movable into and out of meshing engagement with the first mesh mechanism.

7. The apparatus of claim 6 including a pivot mechanism controllably pivotable to slide the sleeve and the second mesh mechanism out of engagement with the first mesh mechanism.

8. The apparatus of claim 1 wherein the sleeve is mounted such that the sleeve is controllably slidable along an axis into and out of engagement with the elongated rod.

9. The apparatus of claim 1 wherein the elongated rod is immovably connected to a frame for the machine, the sleeve and the rod anchoring the manually engageable mechanism to the weight mechanism when the first and second mesh mechanisms are meshed.

10. In a weight resistance exercise machine having a manually engageable mechanism which a user manually engages to perform a weight resistance exercise, the manually engageable mechanism being movable along a predetermined path of movement wherein the manually engageable mechanism is anchorable to a weight mechanism such that the weight mechanism resists movement of the manually engageable mechanism, an apparatus for positioning the manually engageable mechanism in a selected initial position along the path of movement without resistance from the weight mechanism, the apparatus comprising:

an elongated rod having a first mesh mechanism;

a sleeve receiving the rod, the sleeve comprising a half nut having a second complementary mesh mechanism;

the first and second mesh mechanisms being controllably meshable and unmeshable with each other;

the manually engageable mechanism being movable along the predetermined path of movement without resistance from the weight mechanism when the mesh mechanisms are unmeshed.

11. The apparatus of claim 10 wherein the manually engageable mechanism is anchored to weight mechanism when the mesh mechanisms are meshed.

12. The apparatus of claim 10 wherein the second mesh mechanism is biased into meshing engagement with the first mesh mechanism.

13. The apparatus of claim 10 wherein the second mesh mechanism of the sleeve is controllably movable into and out of meshing engagement with the first mesh mechanism.

14. The apparatus of claim 12 wherein the second mesh mechanism of the sleeve is controllably movable into and out of meshing engagement with the first mesh mechanism.

15. The apparatus of claim 14 including a pivot mechanism controllably pivotable to slide the sleeve and the second mesh mechanism out of engagement with the first mesh mechanism.

16. The apparatus of claim 10 wherein the sleeve is mounted such that the sleeve is controllably slidable along an axis into and out of engagement with the elongated rod.

17. The apparatus of claim 10 wherein the elongated rod is immovably connected to a frame for the machine, the sleeve and the rod anchoring the manually engageable mechanism to the weight mechanism when the first and second mesh mechanisms are meshed.

18. In a weight resistance exercise machine having a manually engageable mechanism which is movable along a predetermined path of movement wherein the manually engageable mechanism is anchorable to a weight mechanism such that the weight mechanism resists movement of the manually engageable mechanism, an apparatus for positioning the manually engageable mechanism in a selected initial position along the path of movement without resistance from the weight mechanism, the apparatus comprising:

an elongated rod having a first mesh mechanism;

a sleeve receiving the rod, the sleeve having a second complementary mesh mechanism biased into meshing engagement with the first mesh mechanism, the second mesh mechanism being controllably movable into and out of meshing engagement with the first mesh mechanism by a pivot mechanism which is controllably pivotable to slide the sleeve and the second mesh mechanism out of engagement with the first mesh mechanism;

the manually engageable mechanism being movable along the predetermined path of movement without resistance from the weight mechanism when the mesh mechanisms are unmeshed.

19. The apparatus of claim 18 wherein the manually engageable mechanism is anchored to weight mechanism when the mesh mechanisms are meshed.

20. The apparatus of claim 18 wherein the sleeve comprises a half nut.

21. The apparatus of claim 18 wherein the second mesh mechanism of the sleeve is controllably movable into and out of meshing engagement with the first mesh mechanism.

22. The apparatus of claim 18 wherein the sleeve is mounted such that the sleeve is controllably slidable along an axis into and out of engagement with the elongated rod.

23. The apparatus of claim 18 wherein the elongated rod is immovably connected to a frame for the machine, the sleeve and the rod anchoring the manually engageable mechanism to the weight mechanism when the first and second mesh mechanisms are meshed.

24. In a weight resistance exercise machine having a manually engageable mechanism which a user manually engages during performance of a weight resistance exercise, the manually engageable mechanism being movable along a predetermined path of movement wherein the manually engageable mechanism is anchorable to a weight mechanism such that the weight mechanism resists movement of the manually engageable mechanism, an apparatus for positioning the manually engageable mechanism in a selected initial position along the path of movement without resistance from the weight mechanism, the apparatus comprising:

an elongated rod having a first mesh mechanism;

a sleeve receiving the rod, the sleeve having a second complementary mesh mechanism;

a pivot mechanism interengageable with the sleeve, the first and second mesh mechanisms being controllably meshable and unmeshable with each other by controllable pivoting of the pivot mechanism;

the manually engageable mechanism being movable along the predetermined path of movement without resistance from the weight mechanism when the mesh mechanisms are unmeshed.

25. The apparatus of claim 24 wherein the manually engageable mechanism is anchored to weight mechanism when the mesh mechanisms are meshed.

26. The apparatus of claim 24 wherein the second mesh mechanism is biased into meshing engagement with the first mesh mechanism.

27. The apparatus of claim 24 wherein the sleeve comprises a half nut.

28. The apparatus of claim 24 wherein the second mesh mechanism of the sleeve is controllabiy movable into and out of meshing engagement with the first mesh mechanism.

29. The apparatus of claim 26 wherein the second mesh mechanism of the sleeve is controllably movable into and out of meshing engagement with the first mesh mechanism.

30. The apparatus of claim 24 wherein the sleeve is mounted such that the sleeve is controllably slidable along an axis into and out of engagement with the elongated rod.

31. The apparatus of claim 24 wherein the elongated rod is immovably connected to a frame for the machine, the sleeve and the rod anchoring the manually engageable mechanism to the weight mechanism when the first and second mesh mechanisms are meshed.

* * * * *